US005782857A

United States Patent [19]

Machuron

[11] Patent Number: 5,782,857

[45] Date of Patent: Jul. 21, 1998

[54] FACE WRINKLE REMOVING DEVICE

[75] Inventor: Robert Machuron, Saint Paul de Vence, France

[73] Assignee: Ronic Industries, Nice, France

[21] Appl. No.: 816,340

[22] Filed: Mar. 13, 1997

[30] Foreign Application Priority Data

Mar. 20, 1996 [FR] France ..... 96 03570

[51] Int. Cl.[6] ..... A61H 1/00

[52] U.S. Cl. ..... 606/204.35; 601/70

[58] Field of Search ..... 606/204.35; 601/70, 601/73, 15, 72, 69, 74

[56] References Cited

U.S. PATENT DOCUMENTS 5,396,881 3/1995 Klein ..... 606/204.35

5,551,949 9/1996 Kim ..... 601/70

*Primary Examiner*—Michel Buiz
*Assistant Examiner*—Kevin Truong
*Attorney, Agent, or Firm*—Laubscher & Laubscher

[57] ABSTRACT

A wrinkle removing device comprises, inside a holding body and a sole under the body, a heating resistor for heating the sole, thermostat for temperature controlling the sole in a predetermined control cycle, a motor for producing vibrations and an electrical circuit. The electrical circuit includes the heating resistor, the thermostat and the motor, and is supplied with alternating current to power the heating resistor and the motor, in each case during at least one half-wave of the alternating current throughout the control cycle. With this device, an action of gentle massage of the face is combined with an action of sliding of the heated sole over the face, without producing disagreable variations in the speed of the vibration motor.

7 Claims, 5 Drawing Sheets

FACE WRINKLE REMOVING DEVICE

BACKGROUND OF THE INVENTION

1. Field of the Invention

The present invention concerns a device for removing wrinkles from the face.

2. Description of the Prior Art

A prior art wrinkle removing device known from French patent application No. 2,518,382 includes a thermostatically controlled chamber on which may be placed a metal body having a handle on the top and a concave front part and a convex rear part on the bottom. This prior art device requires the use of two separate parts. It attenuates wrinkles on the face by sliding of the heated bottom part of the metal body over the skin, possibly after application of an appropriate cream.

Other wrinkle removing devices associate heating means for heating the skin with vibration means for adding a massage action. These devices do not automatically control the heating temperature. Further, the mere juxtaposition of heating means, vibration means and temperature control means would not be satisfactory as it would lead to disagreeable variations in the speed of the vibration means because of variations in the electric current flowing through the heating means during temperature variations.

OBJECT OF THE INVENTION

The main object of this invention is to provide a face wrinkle removing device capable of combining heating and massage of the skin with automatic control of the heating temperature and without producing the disagreeable effect referred to above.

SUMMARY OF THE INVENTION

Accordingly, a wrinkle removing device comprising a holding body, a sole under the body, a heating resistor for heating the sole, vibration means including a motor, alternating current power supply means to supply power to the heating resistor and the vibration means, and control means for temperature controlling the sole in a predetermined control cycle having a first part and a second part, the heating resistor and the vibration means having a current flow through them during second half-waves of the alternating current during the first part of the temperature control cycle, and having a current flow through them during first half-waves of the alternating current during the second part of the cycle, and the vibration means having no current flowing through it during the first half-waves of the first part of the cycle, and during the second half-waves of the second part of the cycle.

Thus the speed of the vibration means is maintained substantially constant during the two parts of the temperature control cycle.

The vibration means preferably comprise a motor including an eccentric weight on a motor shaft.

Typically, the device comprises an electrical circuit including four lateral branches and a diagonal branch. A first pair of lateral branches includes a pair of diodes connected in series opposition, respectively, across the bridge input terminals and a second pair of branches includes a thermostat connected in series with a heating resistor and a fuse. The diagonal branch includes a vibrating motor connected in series with a variable resistor, said diagonal branch being connected at one end with the junction between the diodes, and at the other end with the junction between the thermostat and the series connected heating resistance, respectively.

Furthermore, the heating resistor has a current flowing through it during at least one half-wave of each of two parts of a temperature control cycle, but having different values during the first part and second part of the control cycle, respectively.

The shape of the device of the invention must be particularly adapted to removing wrinkles from the face. In this way, the sole to be applied against the face has a front portion with a convex longitudinal section and a triangular cross-section, in particular to fit the concave shapes of the face.

Typically, the front portion of the sole includes a flat against which the heating resistor is fixed, a regularly convex longitudinal section portion and a rounded angular head.

In order to reduce manufacturing costs, the body and the sole are monolithic components, preferably molded and stamped, respectively.

BRIEF DESCRIPTION OF THE DRAWINGS

Other features and advantages of the invention will be apparent from the following detailed description of several preferred embodiments of the invention with reference to the corresponding accompanying drawings in which.

DESCRIPTION OF THE PREFERRED EMBODIMENTS

Figure 1:
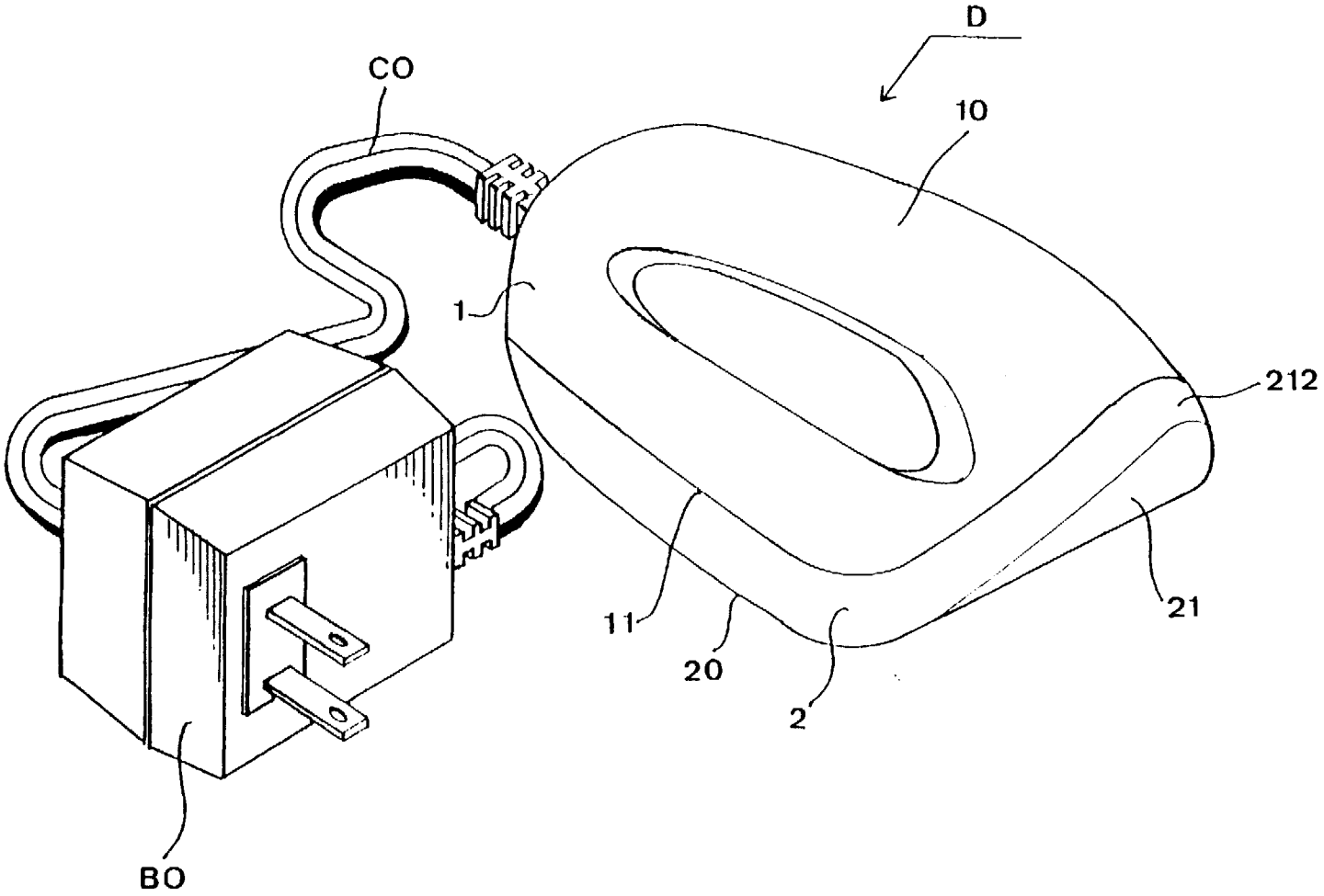
FIG. 1 is a perspective view of a wrinkle removing device in accordance with the invention with its electrical transformer box.

Referring to FIGS. 1 through 5, a wrinkle removing device D of the invention has a monolithic holding body 1 at the top and a monolithic sole 2 designed to be applied to the face at the bottom.

The body 1 is molded from a rigid plastics material such as acrylonitrile-butadiene-styrene (ABS). It has a molded handle 10 at the top and a bottom edge 11 nesting over the sole 2.

Figure 4:
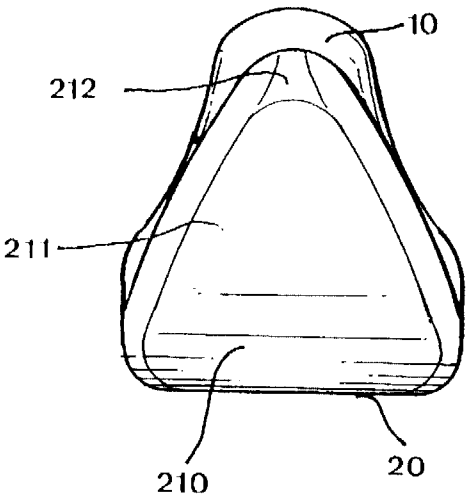
FIGS. 2, 3 and 4 are right side, top and left side views of the wrinkle removing device respectively.
Figure 2:
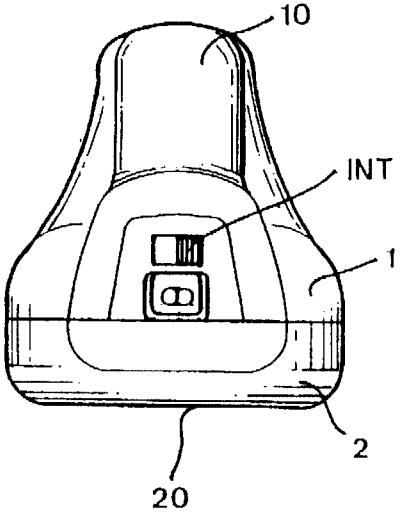
Figure 3:
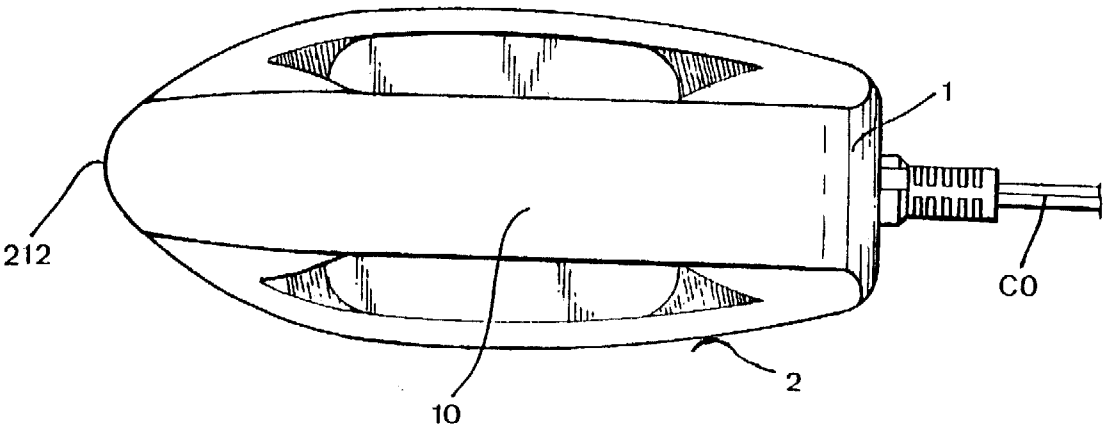

The sole 2 is made up of stamped and anodized aluminum. The sole comprises a flat seat 20 under the plastics material body 1 and a front portion 21 with a convex longitudinal section in the shape of the prow of a boat and an upwardly tappered triangular transverse profile as shown in FIG. 4. The front portion 21 begins at the seat via a flat portion 210, continues with a regularly convex longitudinal section portion 211 and ends in a rounded angular head 212 merging with the front of the handle 10.

The body 1 and the sole 2 have matching shapes and constitute a rigid casing of the device D of the invention.

Figure 5:
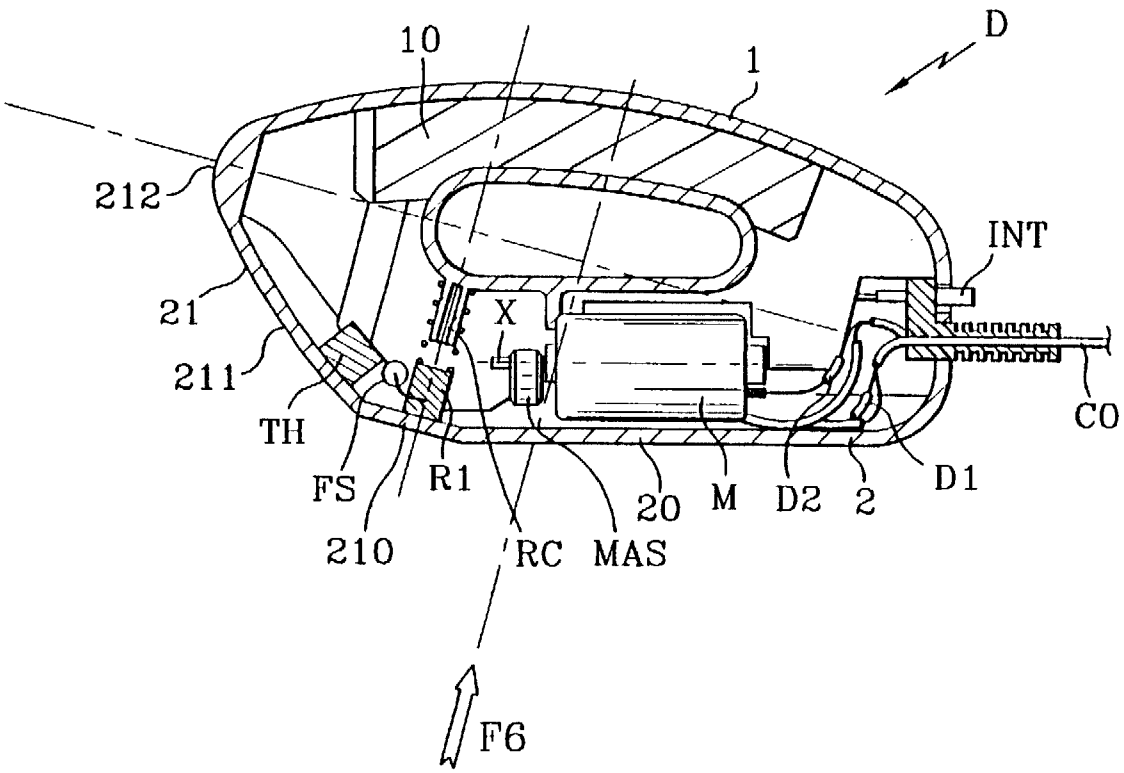
FIG. 5 is a view in longitudinal section of the wrinkle removing device of the present invention
Figure 6:
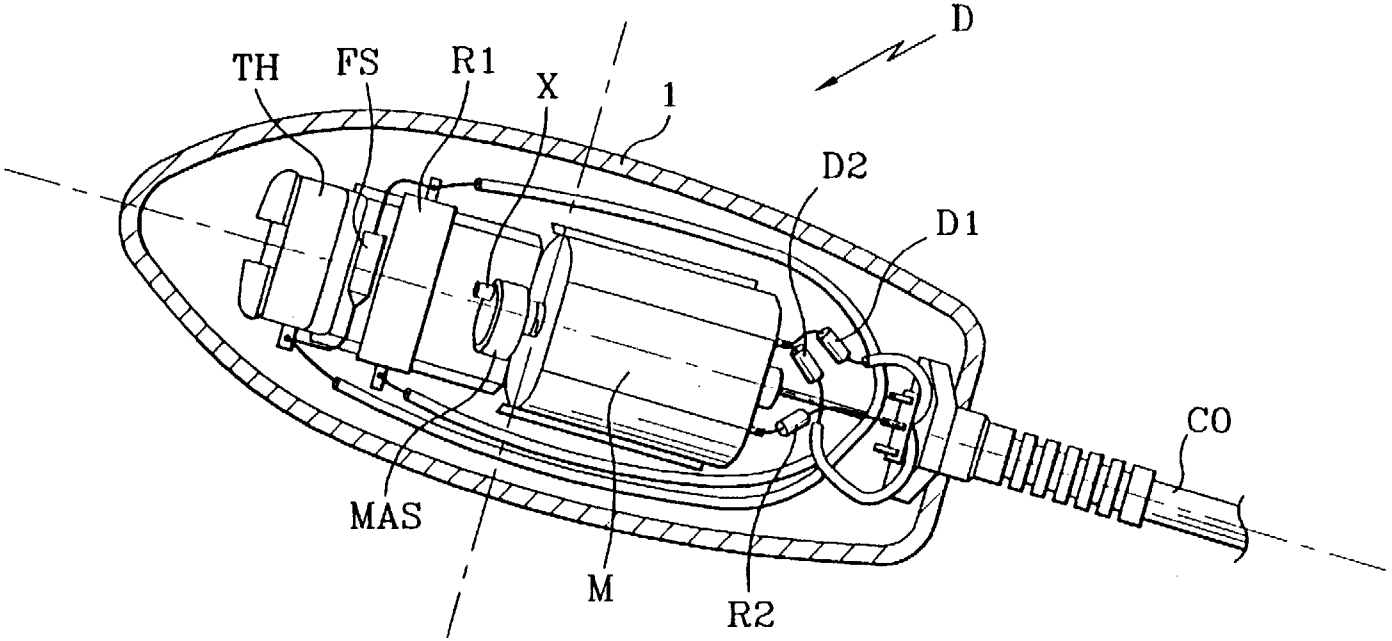
FIG. 6 is a bottom view of the wrinkle removing device without the sole and as seen in the direction of the arrow F6 in FIG. 5.

An electrical power supply cord CO extends from an electrical transformer TR incorporated in a separate box BO adapted to be connected to the mains electrical power supply and enters the rear of the device D at the bottom of the body 1, as shown in FIGS. 1, 5 and 6.

Figure 7:
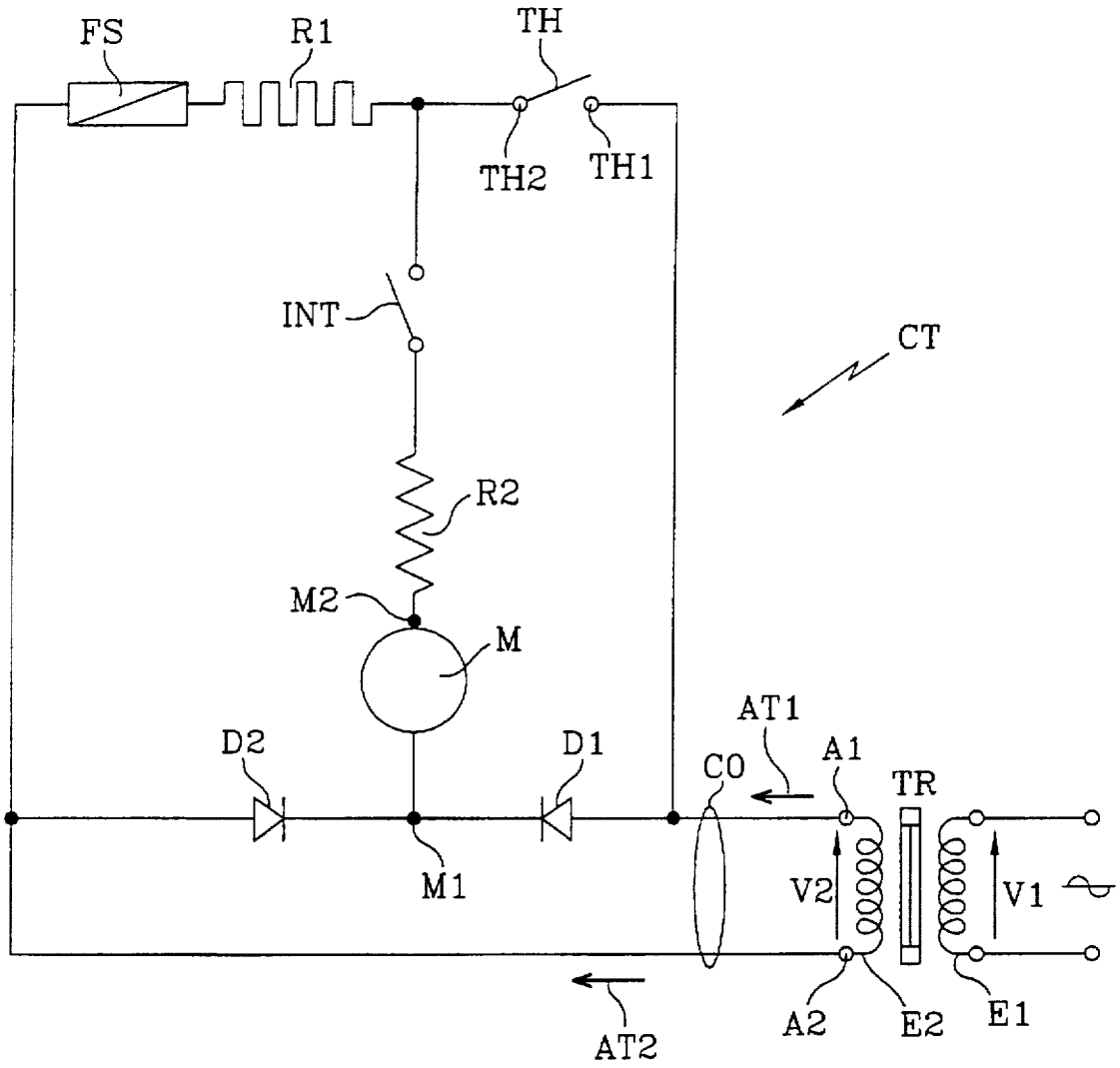
FIG. 7 is a schematic of the electrical circuit in the wrinkle removing device of the present invention.

The transformer feeds an electrical circuit CT shown in FIG. 7 essentially comprising a vibrating motor M, two rectifier diodes D1 and D2 and a heating resistor R1 connected to a control thermostat TH. An ON/OFF switch INT located at the rear of the body 1 is connected to the motor M for starting or stopping the motor M manually. The electrical operation of the wrinkle removing device D of the invention, and in particular the electrical connections between the components referred to above, will be described later with reference to FIG. 7.

The vibrating motor M is rigidly fixed to an inside face of the sole seat 20. The motor M is a direct current motor with a maximal speed of 3500 rpm. The speed of the motor M is preferably variable and can be adjusted using a knob (not shown) located at the rear of the device D and operating a variable resistor R2. The motor M has on its shaft X a small eccentric metal weight MAS. When the motor is energized by closing the switch INT, the rotation of the weight MAS about the motor axis produces vibrations throughout the wrinkle removing device D.

The parallelepiped-shape heating resistor R1 has one flat side fixed to the flat portion 210 on the sole 2 and is held in place by a compression spring RC. When the device D is connected to the mains electrical power supply, the heating resistor R1 heats the sole 2 to a first temperature of about 43° C. after which the thermostat TH controls the temperature to a value between this first temperature and a second heating temperature of about 40° C. In practice, the first and second temperatures mentioned above are those of the interior front part of the device D and more or less those of the portions of the sole 2 near the flat portion 210 to which the heating resistor R1 is fixed and the temperature of which is measured by the thermostat TH. The temperature in the parts of the device farther away from the flat portion, for example the head portion 212, are significantly lower than these temperatures. On average, the temperature of the sole 2 is controlled to a value between about 40° C. and about 43° C. when the sole is not in contact with the skin and between about 38° C. and about 40° C. when the sole is in contact with the skin, i.e., at a temperature near that of the human body.

Before using the wrinkle removing device D a cream is applied to the skin, for example to the face. The heated sole 2 is then slid over the face. If required, the vibrating motor M is started by means of the switch INT for the additional benefit of a face massage, which reinforces the wrinkle removing action.

The convex shape of the front portion 21 of the sole 2 is particularly adapted to the concave shapes of parts of the face such as around the eyes, the corners of the lips, etc and enables bags under the eyes to be reduced by sliding the sole head 212 over them, for example.

Referring to FIG. 7, the transformer TR has a primary winding E1 connected to the mains electrical power supply and a secondary winding E2 with two terminals A1 and A2 which are connected to the electrical circuit CT disposed in the wrinkle removing device D. The transformer TR converts the alternating current voltage V1 of 120 V, 220 V or 240 V provided by the mains electrical power supply or an electrical power supply unit to an alternating current voltage V2 of about 15 V.

The first terminal A1 of the secondary winding E2 is connected to a first terminal TH1 of an internal contact in the thermostat TH and to the anode of the diode D1. The second terminal A2 of the secondary winding E2 is connected to a first terminal of the heating resistor R1 through a safety fuse FS and to the anode of the diode D2. The cathodes of the diodes D1 and D2 are connected together and to a terminal M1 of the direct current motor M. The motor M is connected in series with the variable resistor R2 and the ON/OFF switch INT, one terminal of which is connected both to a second terminal TH2 of the internal contact in the thermostat TH and to a second terminal of the heating resistor R1. The thermostat TH, shown in the form of the aforementioned contact in FIG. 7, further includes a temperature sensor measuring the temperature on the sole 2 near the flat portion 210.

The circuit CT described above is therefore a bridge with four lateral branches and one diagonal branch. Two contiguous lateral branches A1–M1 and A2–M1 include the diodes D1 and D2 connected in polarity opposition. Two other lateral branches A2–TH2 and TH1–TH2 respectively include the heating resistor R1 and the thermostat TH. The vibrating motor M and the variable resistor R2 are connected in series as a diagonal branch having one end connected with the junction between the diodes D1 and D2, and a second end connected with the junction between the thermostat TH and the heating resistor R1.

The resistances of the resistors R1 and R2 are typically 27 Ω and 33 Ω, respectively. The safety fuse FS in contact with one face of the resistor R1 melts at a temperature of about 88° C. and prevents the temperature of the sole 2 reaching too high a value.

After connecting the wrinkle removing device D to the mains electrical power supply, with the ON/OFF switch INT open, i.e. without the motor M operating, the contact of the thermostat TH is closed, and the alternating current produced in the secondary winding E2 of the transformer TR flows through the fuse FS, the heating resistor R1 and the contact of the thermostat TH thereby raising the temperature of the sole at the flat portion 210 to the first temperature of 43° C. When this first temperature has been reached, the contact of the thermostat TH opens, temporarily cutting off the current in the heating resistor R1 and therefore significantly reducing the temperature of the sole 2. The contact of the thermostat TH closes again when the temperature of the sole at the flat is equal to the second temperature of 40° C., and current flows through the resistor R1, which raises the temperature again, and so on.

The motor M can be started at any time by means of the switch INT in order to massage the face.

During a first part of the temperature control cycle, when the switch INT and the contact of the thermostat TH are closed, the motor M is sometimes deactivated, sometimes activated during opposite first and second half-waves AT1 and AT2 of the alternating current respectively flowing through the circuit CT from the first terminal A1 to the second terminal A2 of the winding E2, and from the terminal A2 to the terminal A1. During the first half-wave AT1, the current from the winding terminal A1 flows through the thermostat TH, the heating resistor R1 and the fuse FS, the thermostat contact short-circuiting the diode D1 and the motor M. During the second half-wave AT2, the current from the other winding terminal A2 flows partly through the diode D2 and the motor M and partly through the fuse FS and heating resistor R1, and also the thermostat TH.

When the switch INT is closed and the contact of the thermostat TH is open during a second part of the temperature control cycle, during the first half-wave AT1, the current flows through the diode D1, the motor M, the resistor R1 and the safety fuse FS. During the second half-cycle AT2, no current flows through the circuit CT and in particular through the motor M, in particular because the two rectifier diodes D1 and D2 prevent the passage of any current from the motor M.

The current flowing through the heating resistor R1 takes different values during the two parts of the control temperature cycle. In particular, the average current through the resistor R1 during the second part of the cycle is less than that during the first part of the cycle. During the first part of the cycle the current supplied by the winding E2 flows only through the element R1 and the fuse FS during the first half-wave AT1 and partly through the resistor R1 during the second half-wave AT2, whereas during the second part of the cycle the current supplied by the winding E2 flows through the resistor R1 and the resistor R2 during the first half-wave AT1 and the resistor R1 is not energized during the second half-cycle AT2.

From the foregoing, it follows that when the ON/OFF switch INT is closed to operate the vibrating motor M, the latter operates during only one half-wave of each full wave of the power supply alternating current, i.e. during the second half-wave of the first part of the control cycle when the temperature measured by the thermostat sensor rises from the first to the second temperature, and during the first half-wave of the second part of the control cycle when the temperature falls from the second temperature to the first temperature. This keeps the motor speed relatively constant during the temperature control cycles. If the motor M were supplied in parallel with the resistor R1, the closings and openings of the contact of the thermostat TH would cause jerks due to sudden accelerations and decelerations of the motor M, which would be uncomfortable.

In practice, with the electrical circuit CT of the invention, sometimes the resistor R2 during the first part of the temperature control cycle, sometimes the resistances R2 and R1 during the second part of the temperature control cycle reduce the supply voltage of the circuit from around 15 V to around 12 V, which keeps the speed of the motor substantially constant whilst ensuring decrease of the heating temperature during the second part of the cycle. The deactivation of the motor M during one half-wave of the full wave of the alternating current supply is not noticeable.

The electrical circuit of the invention therefore maintains the heating of the sole by energizing the resistor R1 throughout the first and second parts of the temperature control cycle at least one half-wave of the full wave of the alternating current supply, and also maintains substantially regular operation of the motor M throughout the temperature control cycle.

What I claim is:

1. A wrinkle-removing device, comprising:

(a) a hollow holding body having a bottom portion including a sole;

(b) heating means including a heating resistor for heating said sole;

(c) vibration means including a motor arranged within said holding body;

(d) power supply means for supplying alternating current power to said motor and to said heating resistor; and (e) control means including a thermostat for controlling the temperature of said sole in a predetermined temperature control cycle having a first part and a second part;

(f) said heating means being supplied with the first and second half-waves of the alternating current supply during the first part of the temperature control cycle, and with only the first half-waves of the alternating current supply in the opposite direction during the second part of the control cycle;

(g) said vibration means being supplied only with the second half-waves of the alternating current supply during the first part of the temperature control cycle, and only with first half-waves of the alternating current supply during the second part of the control cycle.

2. A wrinkle-removing device as defined in claim 1, wherein said power supply means includes:

(1) transformer means including primary and secondary windings; and (2) bridge means including:

(a) a pair of diodes connected in series opposition across said secondary winding, said thermostat and said heating resistor also being connected in series across said secondary winding; and (b) an on-off switch connected in series with said motor as a diagonal branch having one end connected between said diodes, and a second end connected between said heating resistor and said thermostat, whereby said motor has only second half-waves of the alternating current supply flowing therethrough during the first part of the temperature control cycle, and only the first half-cycles of the alternating current supply flowing therethrough during the second part of the temperature control cycle.

3. The wrinkle-removing device as defined in claim 2, wherein said heating resistor has different current values flowing therethrough during said first and second parts of the temperature control cycle, respectively.

4. The wrinkle removing device claimed in claim 1, wherein said sole has a front portion with a convex longitudinal section and a triangular cross-section.

5. The wrinkle removing device claimed in claim 1, wherein a front portion of said sole includes a flat against which said heating resistor is fixed, a regularly convex longitudinal section portion and a rounded angular head.

6. The wrinkle removing device claimed in claim 1, wherein said body and said sole are monolithic components.

7. The wrinkle removing device claimed in claim 1, wherein said body and said sole are molded and stamped components respectively.

* * * * *